US009587504B2

(12) United States Patent
McCaffrey et al.

(10) Patent No.: US 9,587,504 B2
(45) Date of Patent: Mar. 7, 2017

(54) CARRIER INTERLOCK

(71) Applicant: United Technologies Corporation, Hartford, CT (US)

(72) Inventors: Michael G. McCaffrey, Windsor, CT (US); Brandon T. Rouse, Anacortes, WA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1080 days.

(21) Appl. No.: 13/675,292

(22) Filed: Nov. 13, 2012

(65) Prior Publication Data

US 2014/0133955 A1 May 15, 2014

(51) Int. Cl.
*F01D 11/08* (2006.01)
*F01D 9/04* (2006.01)

(52) U.S. Cl.
CPC ..... *F01D 11/08* (2013.01); *F01D 9/04* (2013.01)

(58) Field of Classification Search
CPC ..... F01D 11/025; F01D 11/08; F01D 11/12; F01D 11/14; F01D 11/16; F01D 11/18; F01D 25/243
See application file for complete search history.

(56) References Cited

U.S. PATENT DOCUMENTS 4,679,981 A 7/1987 Guibert et al.
4,988,266 A * 1/1991 Nakamura ..... C22C 19/055 415/173.1
5,333,992 A 8/1994 Kane et al.
5,375,973 A 12/1994 Sloop et al.
5,609,469 A 3/1997 Worley et al.
5,988,975 A 11/1999 Pizzi
6,508,623 B1 1/2003 Shiozaki et al.
6,884,026 B2 * 4/2005 Glynn ..... F01D 11/08 415/113
7,665,955 B2 2/2010 Liang
7,665,962 B1 2/2010 Liang
7,704,039 B1 4/2010 Liang
8,092,160 B2 1/2012 Shi et al.
2006/0216146 A1 9/2006 Thompson et al.
2009/0148277 A1 6/2009 Tholen et al.
2009/0208322 A1 8/2009 McCaffrey
(Continued)

FOREIGN PATENT DOCUMENTS

EP 1746225 1/2001
EP 1873355 1/2008
EP 1965031 9/2008

OTHER PUBLICATIONS

International Search Report and Written Opinion for PCT/US2013/069523 mailed Aug. 19, 2014.
(Continued)

*Primary Examiner* — Igor Kershteyn
(74) *Attorney, Agent, or Firm* — Carlson, Gaskey & Olds, P.C.

(57) ABSTRACT

A gas turbine engine according to an exemplary aspect of the present disclosure includes, among other things, an engine case, a rotor stage including a plurality of rotor blades, a plurality of carriers for supporting a plurality of blade outer air seals and an interlock formed between circumferential ends of a first adjacent carrier and a second adjacent carrier of the plurality of carriers.

21 Claims, 3 Drawing Sheets

(56) References Cited

U.S. PATENT DOCUMENTS

| | | | |
|---|---|---|---|
| 2010/0232940 | A1 | 9/2010 | Ammann |
| 2011/0044801 | A1 | 2/2011 | Di Paola et al. |
| 2012/0275898 | A1 | 11/2012 | McCaffrey et al. |

OTHER PUBLICATIONS

International Preliminary Report on Patentability for PCT/US2013/069523 mailed May 28, 2015.
Extended European Search Report for European Application No. 13872958.7, mailed Dec. 12, 2015.

* cited by examiner

CARRIER INTERLOCK

STATEMENT REGARDING FEDERALLY SPONSORED RESEARCH OR DEVELOPMENT

This disclosure was made with Government support under N00019-12-D-0002 awarded by The United States Navy. The Government has certain rights in this disclosure.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Gas turbine engines include rotating blade stages in the fan section, the compressor section, and/or the turbine section. Clearance between the blade tips and the adjacent non-rotating structure may influence engine performance. The clearance may be influenced by mechanical loading due to centrifugal forces and/or thermal expansion of the blades or the non-rotating structure.

SUMMARY

A gas turbine engine according to an exemplary aspect of the present disclosure includes, among other things, an engine case, a rotor stage including a plurality of rotor blades, a plurality of carriers for supporting a plurality of blade outer air seals and an interlock formed between circumferential ends of a first adjacent carrier and a second adjacent carrier of the plurality of carriers.

In a further non-limiting embodiment of the foregoing gas turbine engine, the interlock includes a projection on the first adjacent carrier and a receptacle on the second adjacent carrier.

In a further non-limiting embodiment of either of the foregoing gas turbine engines, the projection includes a first slanted surface and a second slanted surface and the receptacle includes a corresponding first slanted surface and a corresponding second slanted surface.

In a further non-limiting embodiment of any of the foregoing gas turbine engines, the projection includes a first perpendicular surface, a second perpendicular surface, and a third surface that connects the first perpendicular surface and the second perpendicular surface and is substantially parallel to a circumferential end of the first adjacent carrier. The receptacle includes a corresponding first perpendicular surface, second perpendicular surface, and third surface that is generally parallel to the circumferential end of the second adjacent carrier.

In a further non-limiting embodiment of any of the foregoing gas turbine engines, the projection includes a first slanted surface, a second slanted surface, and a third surface that connects the first slanted surface to the second slanted surface. The third surface is substantially parallel to the circumferential end of the first adjacent carrier. The receptacle includes a corresponding first slanted surface, second slanted surface, and third surface that is generally parallel to the circumferential end of the second adjacent carrier.

In a further non-limiting embodiment of any of the foregoing gas turbine engines, the plurality of carriers surround an annular central ring.

In a further non-limiting embodiment of any of the foregoing gas turbine engines, the plurality of carriers include a central opening with a biasing member located within the central opening between the central ring and the plurality of carriers.

In a further non-limiting embodiment of any of the foregoing gas turbine engines, each of the plurality of carriers include a first portion and a second portion connected by at least one fastener.

In a further non-limiting embodiment of any of the foregoing gas turbine engines, the plurality of carriers each include a first radial tab for mating with a first slot on the engine case.

In a further non-limiting embodiment of any of the foregoing gas turbine engines, the plurality of carriers each include a second radial tab for mating with a second slot on the engine case.

A carrier for a gas turbine engine according to an exemplary aspect of the present discourse includes, among other things, a radial tab for engaging an engine case and an interlock including at least one of a projection or a receptacle on the carrier for engaging the other of the at least one of the projection or the receptacle on an adjacent carrier.

In a further non-limiting embodiment of the foregoing carrier, the carrier includes at least one of the projection or the receptacle on a first circumferential end of the carrier and at least one of the projection or the receptacle on a second circumferential end of the carrier.

In a further non-limiting embodiment of either of the foregoing carriers, the projection includes a first slanted surface and a second slanted surface and the receptacle includes a corresponding first slanted surface and a corresponding second slanted surface.

In a further non-limiting embodiment of any of the foregoing carriers, the projection includes a first perpendicular surface, a second perpendicular surface, and a third surface that connects the first perpendicular surface and the second perpendicular surface and is substantially parallel to the circumferential end of the carrier. The receptacle includes a corresponding first perpendicular surface, second perpendicular surface, and third surface that is generally parallel to the circumferential end of the carrier.

In a further non-limiting embodiment of any of the foregoing carriers, the projection includes a first slanted surface, a second slanted surface, and a third surface that connects the first slanted surface to the second slanted surface. The third surface is substantially parallel to the circumferential end of the carrier. The receptacle includes a corresponding first slanted surface, second slanted surface, and third surface that is generally parallel to the circumferential end of the carrier.

A method of operating a gas turbine engine according to another exemplary aspect of the present disclosure includes, among other things, running the gas turbine engine. The gas turbine engine includes a plurality of carriers for supporting a plurality of blade outer air seals and an interlock between a circumferential end on a first adjacent carrier of the plurality of carriers with a circumferential end on a second adjacent carrier of the plurality of carriers, such that movement of the first adjacent carrier in a radial direction moves the second adjacent carrier with the same direction and magnitude as the first adjacent carrier In a further non-limiting embodiment of the foregoing method of operating a gas turbine engine, the interlock includes a projection on the first adjacent and a receptacle on the second adjacent carrier.

In a further non-limiting embodiment of either of the foregoing methods of operating a gas turbine engine, the projection includes a first slanted surface and a second slanted surface. The receptacle includes a corresponding first slanted surface and a corresponding second slanted surface.

In a further non-limiting embodiment of any of the foregoing methods of operating a gas turbine engine, the projection includes a first perpendicular surface, a second perpendicular surface, and a third surface that connects the first perpendicular surface and the second perpendicular surface and is substantially parallel to a circumferential end of the first adjacent carrier. The receptacle includes a corresponding first perpendicular surface, second perpendicular surface, and third surface that is generally parallel to a circumferential end of the second adjacent carrier.

In a further non-limiting embodiment of any of the foregoing methods of operating a gas turbine engine, the projection includes a first slanted surface, a second slanted surface, and a third surface that connects the first slanted surface to the second slanted surface. The third surface is substantially parallel to a circumferential end of the first adjacent carrier. The receptacle includes a corresponding first slanted surface, second slanted surface, and third surface that is generally parallel to a circumferential end of the second adjacent carrier.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
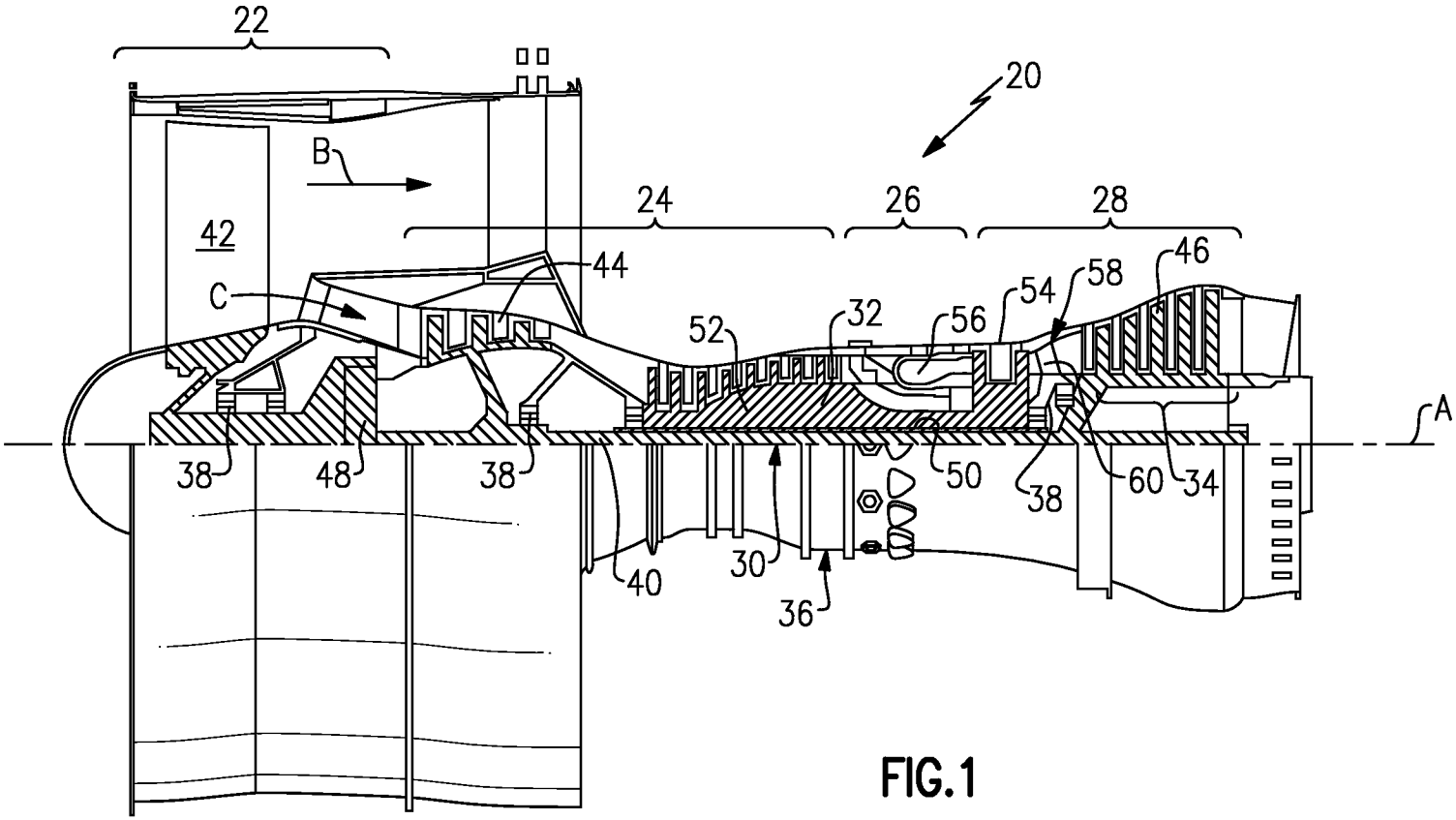
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Referring to FIGS. 2-5, an example rotor stage 62 includes rotor blades 64, a case 66, such as a compressor or engine case, a central ring 70, and carriers 72 for supporting blade outer air seals 68. In this example, each of the carriers 72 support a first blade outer air seal 68 and a second blade outer air seal 68 and surround the central ring 70. The central ring 70 is a continuous annular ring. The distal ends of each of the rotor blades 64 are spaced from the blade outer air seals 68 by a distance RC.

In this example, the carrier 72 includes a first portion 74 and a second portion 76 that form a central opening 80 for accepting the central ring 70. The first portion 74 and the second portion 76 are secured to each other using fasteners 82, such as bolts with nuts.

The first portion 74 of the carrier 72 includes a slot 110 for accepting a first group of tabs 112 on the blade outer air seal 68 and the second portion 76 includes a slot 114 for accepting a second group of tabs 116 on the blade outer air seal 68. A seal 118 extends between adjacent blade outer air seals 68.

An example interlock 83 includes a projection 84 on a carrier 72 received within a receptacle 86' on an adjacent carrier 72'. In this example, the projection 84 is located on a first circumferential end of the carrier 72 and the receptacle 86' is located on a second circumferential end of the adjacent carrier 72'. The projection 84 on the carrier 72 includes an elongated portion with a rounded distal end that is configured to mate with the receptacle 86' having an elongated opening with a rounded base portion on the adjacent carrier 72'. The clearance between the projection 84 and a corresponding receptacle 86' on an adjacent carrier 72' is such that movement of the carrier 72 in a radial direction will move the adjacent carrier 72' with the same direction and magnitude as the carrier 72.

The first portion 74 of the carrier 72 includes a first radial tab 88 that is received within a slot 90 on the case 66. The first radial tab 88 extends outward from the front axial face of the carrier 72 and outward from a radially outer surface of the carrier 72. The slot 90 is defined by a first arm 92 and a second arm 94 that extends radially inward from an inner surface of the case 66. The distal ends of the first arm 92 and the second arm 94 are tapered.

A biasing member 102 is located on the radially inner side of the central opening 80 between the central ring 70 and the carrier 72. The biasing member 102 biases the carrier 72 radially inward and allows for expansion of the carriers 72 radially outward during operation of the gas turbine engine.

Figure 2:
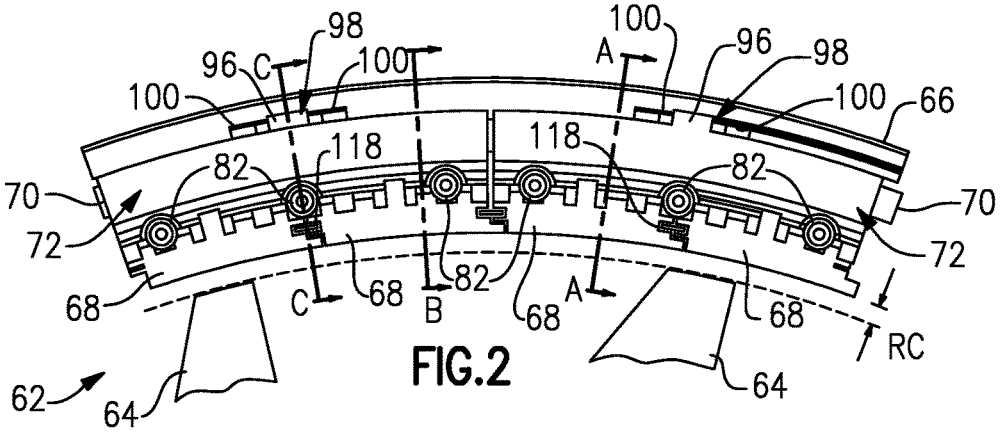
FIG. 2 is a rear view of an example carrier with blade outer air seals.
Figure 4:
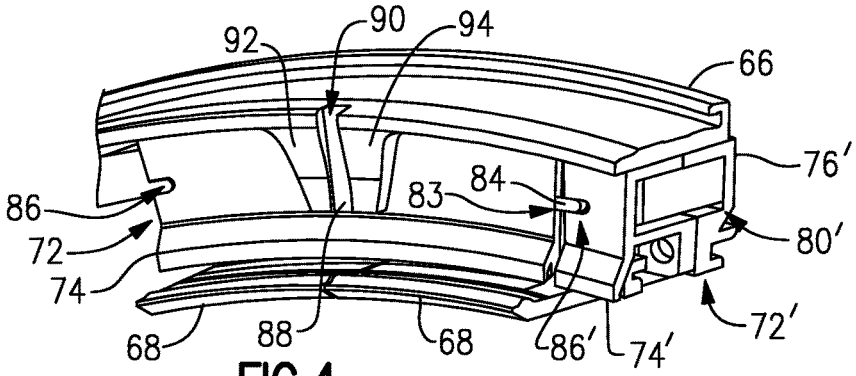
FIG. 4 is a cross-sectional front perspective view of the carrier and blade outer air seals of FIG. 2 taken along line B-B showing an example interlock.
Figure 3:
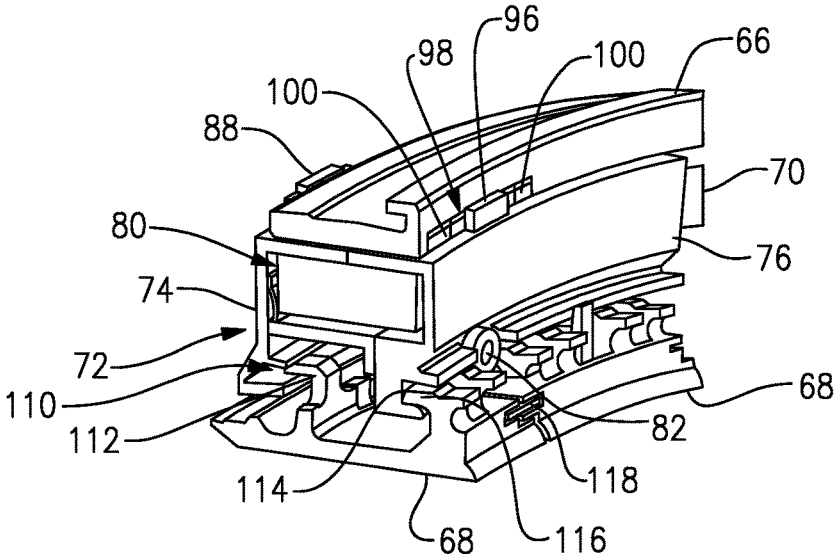
FIG. 3 is a cross-sectional rear perspective view of the carrier and blade outer air seals of FIG. 2 taken along line A-A.
Figure 5:
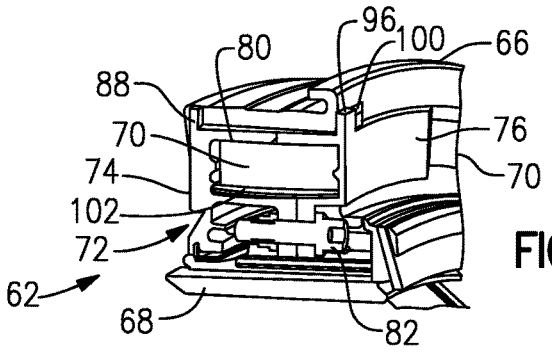
FIG. 5 is a cross-sectional rear perspective view of the carrier and blade outer air seals of FIG. 2 taken along line C-C.

A second radial tab 96 extends radially outward from a radially outer surface of the carrier 72. The second radial tab 96 is received within a second radial slot 98 formed on an axial rear end of the case 66 by a pair of a slot projections 100 (FIG. 2). The first radial tab 88 and the second radial tab 96 allow the carrier 72 to move radially inward and outward to accommodate for thermal expansion and circumferential forces during operation.

Figure 6:
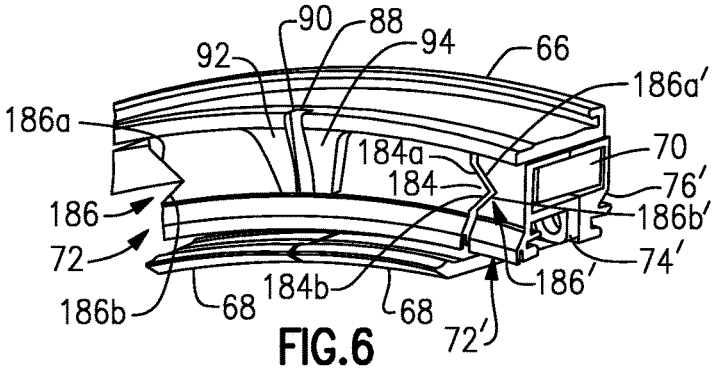
FIG. 6 is a cross-sectional front perspective view of the carrier and blade outer air seals showing another example interlock.

FIG. 6 illustrates an interlock 183 according to another example embodiment. The example interlock 183 includes a chevron projection 184 on a first circumferential end of the carrier 72 and a corresponding chevron receptacle 186' on a second circumferential end of the carrier 72'. The chevron projection 184 includes a first slanted surface **184*a* and a second slanted surface 184*b*. The chevron receptacle 186' includes a first slanted surface 186*a*' and a second slanted surface 186*b*'. The clearance between the chevron projection 184 and a corresponding chevron receptacle 186' on an adjacent carrier 72' is such that movement of the carrier 72 in a radial direction will move the adjacent carrier 72' with the same direction and magnitude as the carrier 72. Although the chevron projection 184 and chevron receptacle 186' are located on the first portions 74 and 74' of the carriers 72 and 72', the second portions 76 and 76' of the carriers 72 and 72' may also include a similar chevron projection 184 and chevron receptacle 186'**.

Figure 7:
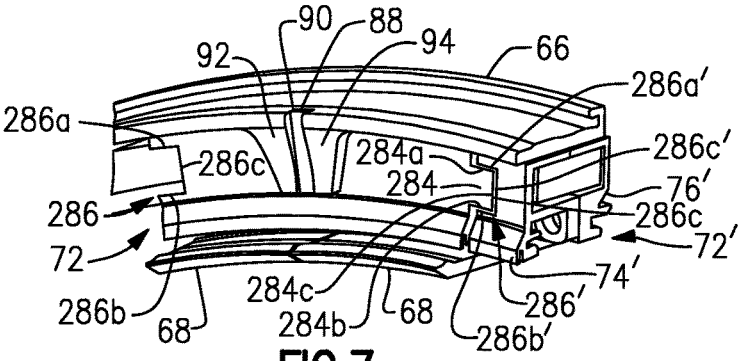
FIG. 7 is a cross-sectional front perspective view of the carrier and blade outer air seals showing yet another example interlock.

FIG. 7 illustrates an interlock 283 according to yet another example embodiment. The example interlock 283 includes an interlocking projection 284 located on a first circumferential end of the carrier 72 and an interlocking receptacle 286' located on a second circumferential end of the carrier 72'. The interlocking projection 284 includes a first perpendicular surface 284*a*, a second perpendicular surface 284*b*, and a third surface 284*c* that connects the first and second perpendicular surfaces 284*a* and 284*b*. The third surface 284*c* is generally parallel to the first circumferential end of the carrier 72. The interlocking receptacle 286' includes a first perpendicular surface 286*a*', a second perpendicular surface 286*b*', and a third surface 286*c*' that connects the first and second perpendicular surfaces 286*a*' and 286*b*'. The third surface 286*c*' is generally parallel to the second circumferential end of the carrier 72'. Clearance between the interlocking projection 284 and a corresponding interlocking receptacle 286' on an adjacent carrier 72' is such that movement of the carrier 72 in a radial direction will move the adjacent carrier 72' with the same direction and magnitude as the carrier 72. Although the interlocking projection 284 and the interlocking receptacle 286' are located on the first portions 74 and 74' of the carriers 72 and 72', the second portions 76 and 76' of the carriers 72 and 72' may also include a similar interlocking projection 284 and interlocking receptacle 286'.

Figure 8:
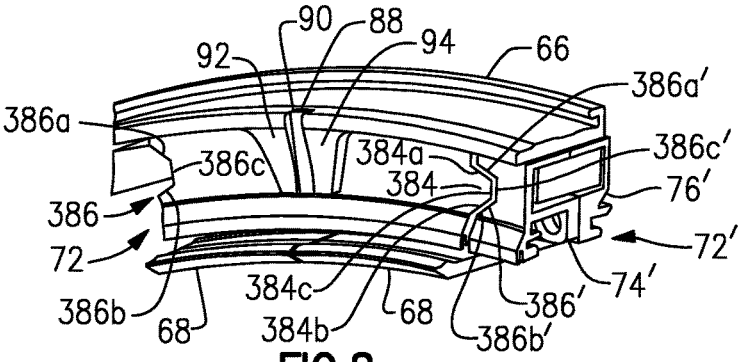
FIG. 8 is a cross-sectional front perspective view of the carrier and blade outer air seals showing still another example interlock.

FIG. 8 illustrates an interlock 283 according to still another example embodiment. The example interlock 283 includes an interlocking projection 384 located on a first circumferential end of the carrier 72' and an interlocking receptacle 386' located on a second circumferential end of the carrier 72'. The interlocking projection 384 includes a first slanted surface 384*a*, a second slanted surface 384*b*, and a third surface 384*c* that connects the first and second slanted surfaces 384*a* and 384*b*. The third surface 384*c* is generally parallel to the first circumferential end of the carrier 72. The interlocking receptacle 386' includes a first slanted surface 386*a*', a second slanted surface 386*b*', and a third surface 386*c*' that connects the first and second slanted surfaces 386*a*' and 386*b*'. The third surface 386*c*' is generally parallel to the second circumferential end of the carrier 72'. Clearance between the interlocking projection 384 and a corresponding interlocking receptacle 386' on an adjacent carrier 72' is such that movement of the carrier 72 in a radial direction will move the adjacent carrier 72' with the same direction and magnitude as the carrier 72. Although the interlocking projection 384 and the interlocking receptacle 386' are located on the first portions 74 and 74' of the carrier 72 and 72', the second portions 76 and 76' of the carriers 72 and 72' may also include a similar projection 384 and receptacle 386'.

Although the disclosed example is described in reference to a high pressure compressor case, it is within the contemplation of this disclosure that it be utilized with another compressor or turbine section, or some other area of the engine.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A gas turbine engine comprising:

an engine case;

a rotor stage including a plurality of rotor blades;

a plurality of carriers for supporting a plurality of blade outer air seals; and an interlock formed between circumferential ends of a first adjacent carrier and a second adjacent carrier of the plurality of carriers.

2. The gas turbine engine of claim 1, wherein the interlock includes a projection on the first adjacent carrier and a receptacle on the second adjacent carrier.

3. The gas turbine engine of claim 2, wherein the projection includes a first slanted surface and a second slanted surface and the receptacle includes a corresponding first slanted surface and a corresponding second slanted surface.

4. The gas turbine engine of claim 2, wherein the projection includes a first perpendicular surface, a second perpendicular surface, and a third surface that connects the first perpendicular surface and the second perpendicular surface and is substantially parallel to a circumferential end of the first adjacent carrier, and the receptacle includes a corresponding first perpendicular surface, second perpendicular surface, and third surface that is generally parallel to the circumferential end of the second adjacent carrier.

5. The gas turbine engine of claim 2, wherein the projection includes a first slanted surface, a second slanted surface, and a third surface that connects the first slanted surface to the second slanted surface, the third surface is substantially parallel to the circumferential end of the first adjacent carrier and the receptacle includes a corresponding first slanted surface, second slanted surface, and third surface that is generally parallel to the circumferential end of the second adjacent carrier.

6. The gas turbine engine of claim 1, including an annular central ring, the plurality of carriers surround the annular central ring.

7. The gas turbine engine of claim 6, wherein the plurality of carriers include a central opening with a biasing member located within the central opening between the central ring and the plurality of carriers.

8. The gas turbine engine of claim 1, wherein each of the plurality of carriers include a first portion and a second portion connected by at least one fastener.

9. The gas turbine engine of claim 1, wherein the plurality of carriers each include a first radial tab for mating with a first slot on the engine case.

10. The gas turbine engine of claim 9, wherein the plurality of carriers each include a second radial tab for mating with a second slot on the engine case.

11. A carrier for a gas turbine engine comprising:

a radial tab for engaging an engine case; and an interlock including at least one of a projection or a receptacle on the carrier for engaging the other of the at least one of the projection or the receptacle on an adjacent carrier.

12. The carrier of claim 11, wherein the carrier includes at least one of the projection or the receptacle on a first circumferential end of the carrier and at least one of the projection or the receptacle on a second circumferential end of the carrier.

13. The carrier of claim 12, wherein the projection includes a first slanted surface and a second slanted surface and the receptacle includes a corresponding first slanted surface and a corresponding second slanted surface.

14. The carrier of claim 12, wherein the projection includes a first perpendicular surface, a second perpendicular surface, and a third surface that connects the first perpendicular surface and the second perpendicular surface and is substantially parallel to the circumferential end of the carrier, and the receptacle includes a corresponding first perpendicular surface, second perpendicular surface, and third surface that is generally parallel to the circumferential end of the carrier.

15. The carrier of claim 12, wherein the projection includes a first slanted surface, a second slanted surface, and a third surface that connects the first slanted surface to the second slanted surface, the third surface is substantially parallel to the circumferential end of the carrier and the receptacle includes a corresponding first slanted surface, second slanted surface, and third surface that is generally parallel to the circumferential end of the carrier.

16. The carrier of claim 11, including an annular central ring, the plurality of carriers surround the annular central ring and the plurality of carriers include a central opening with a biasing member located within the central opening between the central ring and the plurality of carriers.

17. A method of operating a gas turbine engine comprising:

running the gas turbine engine including a plurality of carriers for supporting a plurality of blade outer air seals; and engaging an interlock between a circumferential end on a first adjacent carrier of the plurality of carriers with a circumferential end on a second adjacent carrier of the plurality of carriers, wherein movement of the first adjacent carrier in a radial direction moves the second adjacent carrier with the same direction and magnitude as the first adjacent carrier.

18. The method of claim 17, wherein the interlock includes a projection on the first adjacent and a receptacle on the second adjacent carrier.

19. The method of claim 18, wherein the projection includes a first slanted surface and a second slanted surface and the receptacle includes a corresponding first slanted surface and a corresponding second slanted surface.

20. The method of claim 18, wherein the projection includes a first perpendicular surface, a second perpendicular surface, and a third surface that connects the first perpendicular surface and the second perpendicular surface and is substantially parallel to a circumferential end of the first adjacent carrier, and the receptacle includes a corresponding first perpendicular surface, second perpendicular surface, and third surface that is generally parallel to a circumferential end of the second adjacent carrier.

21. The method of claim 18, wherein the projection includes a first slanted surface, a second slanted surface, and a third surface that connects the first slanted surface to the second slanted surface, the third surface is substantially parallel to a circumferential end of the first adjacent carrier and the receptacle includes a corresponding first slanted surface, second slanted surface, and third surface that is generally parallel to a circumferential end of the second adjacent carrier.

* * * * *